US010151149B2

(12) United States Patent
Propes et al.

(10) Patent No.: US 10,151,149 B2
(45) Date of Patent: Dec. 11, 2018

(54) ROLLING CUTTER ASSEMBLIES

(71) Applicant: Halliburton Energy Services, Inc., Houston, TX (US)

(72) Inventors: Christopher Charles Propes, Montgomery, TX (US); Brian Atkins, The Woodlands, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 315 days.

(21) Appl. No.: 14/758,439

(22) PCT Filed: Jul. 28, 2014

(86) PCT No.: PCT/US2014/048362
§ 371 (c)(1),
(2) Date: Jun. 29, 2015

(87) PCT Pub. No.: WO2016/018204
PCT Pub. Date: Feb. 4, 2016

(65) Prior Publication Data

US 2016/0290056 A1 Oct. 6, 2016

(51) Int. Cl.
*E21B 10/567* (2006.01)
*E21B 10/50* (2006.01)
(Continued)

(52) U.S. Cl.
CPC ..... *E21B 10/50* (2013.01); *E21B 10/43* (2013.01); *E21B 10/573* (2013.01); *E21B 10/02* (2013.01); *E21B 10/26* (2013.01)

(58) Field of Classification Search
CPC ..... E21B 10/573; E21B 10/567; E21B 10/55; E21B 2010/545; E21B 2010/564;
(Continued)

(56) References Cited

U.S. PATENT DOCUMENTS 4,222,446 A 9/1980 Vasek
4,553,615 A 11/1985 Grainger
(Continued)

FOREIGN PATENT DOCUMENTS

CN 103492661 A 1/2014
WO WO-2013101864 A1 7/2013
WO 2016018204 A1 2/2016

OTHER PUBLICATIONS

International Search Report and Written Opinion for PCT/US2014/048362 dated Apr. 24, 2015.
(Continued)

*Primary Examiner* — Kenneth L Thompson
(74) *Attorney, Agent, or Firm* — Alan Bryson; Tumey L.L.P.

(57) ABSTRACT

An example rolling cutter assembly includes a rolling cutter disposable within a cutter pocket defined in a drill bit, the cutter pocket including a receiving end, a bottom end, and a sidewall extending between the receiving and bottom ends. The rolling cutter provides a substrate having a first end with a diamond table disposed thereon and a second end arrangeable within the cutter pocket at or near the bottom end. A bearing element is disposable within the cutter pocket at the bottom end and engageable with the second end of the rolling cutter as the rolling cutter rotates about a central axis.

20 Claims, 2 Drawing Sheets

(51) Int. Cl.

| | |
|---|---|
| ***E21B 10/43*** | (2006.01) |
| ***E21B 10/573*** | (2006.01) |
| *E21B 10/02* | (2006.01) |
| *E21B 10/26* | (2006.01) |

(58) Field of Classification Search
CPC .. E21B 2010/561; E21B 33/047; E21B 19/02; E21B 33/04
USPC ..... 175/432
See application file for complete search history.

(56) References Cited

U.S. PATENT DOCUMENTS

| | | | | |
|---|---|---|---|---|
| 4,751,972 | A | 6/1988 | Jones et al. | |
| 7,703,559 | B2 | 4/2010 | Shen et al. | |
| 7,762,359 | B1 | 7/2010 | Miess | |
| 8,079,431 | B1 | 12/2011 | Cooley et al. | |
| 9,291,000 | B2 * | 3/2016 | Zhang | E21B 10/50 |
| 9,624,731 | B2 * | 4/2017 | Haugvaldstad | E21B 10/567 |
| 2006/0278441 | A1 | 12/2006 | Cooley et al. | |
| 2007/0278017 | A1 | 12/2007 | Shen et al. | |
| 2009/0158898 | A1 | 6/2009 | Sherwood, Jr. et al. | |
| 2010/0187020 | A1 | 7/2010 | Zhang et al. | |
| 2011/0284293 | A1 | 11/2011 | Shen et al. | |
| 2012/0273280 | A1 * | 11/2012 | Zhang | E21B 10/573 175/428 |
| 2013/0140094 | A1 | 6/2013 | Burhan et al. | |
| 2013/0146367 | A1 | 6/2013 | Zhang et al. | |
| 2013/0220707 | A1 | 8/2013 | Shen et al. | |
| 2013/0277121 | A1 * | 10/2013 | Stevens | B22D 19/06 175/425 |
| 2017/0107768 | A1 * | 4/2017 | Saini | E21B 10/5735 |

OTHER PUBLICATIONS

International Preliminary Report on Patentability from PCT/US2014/048362, dated Feb. 9, 2017.

* cited by examiner

ROLLING CUTTER ASSEMBLIES

This application is the national stage application of PCT Application No. PCT/US2014/048362 filed on Jul. 28, 2014.

BACKGROUND

The present disclosure relates to earth-penetrating drill bits and, more particularly, to rolling cutters that can be used in drill bits.

Wellbores for the oil and gas industry are commonly drilled by a process of rotary drilling. In conventional wellbore drilling, a drill bit is mounted on the end of a drill string, which may be several miles long. At the surface of the wellbore, a rotary drive turns the drill string, including the drill bit arranged at the bottom of the hole to increasingly penetrate the subterranean formation, while drilling fluid is pumped through the drill string. In other drilling configurations, the drill bit may be rotated using a mud motor arranged axially adjacent the drill bit in the downhole environment and powered using the circulating drilling fluid.

One common type of drill bit used to drill wellbores is known as a "fixed cutter" or a "drag" bit. This type of drill bit has a bit body formed from a high strength material, such as tungsten carbide or steel, or a composite/matrix bit body, having a plurality of cutters (also referred to as cutter elements, cutting elements, or inserts) attached at selected locations about the bit body. The cutters may include a substrate or support stud made of carbide (e.g., tungsten carbide), and an ultra-hard cutting surface layer or "table" made of a polycrystalline diamond material or a polycrystalline boron nitride material deposited onto or otherwise bonded to the substrate. Such cutters are commonly referred to as polycrystalline diamond compact ("PDC") cutters.

In fixed cutter drill bits, PDC cutters are typically located within corresponding cutter pockets defined within blades that extend from the bit body, and can be bonded to the blades by brazing to the inner surfaces of the cutter pockets. The PDC cutters are positioned along the leading edges of the blades of the bit body so that rotating the bit body results in the PDC cutters engaging the rock to penetrate the underlying formation. In use, high forces are exerted on the PDC cutters, particularly in the forward-to-rear direction. PDC cutters are typically fixed to the bit body such that a common cutting surface contacts the formation during drilling. Over time, however, the edge of the working surface of the PDC cutter that constantly contacts the formation can wear down or dull, which can result in longer drill times due to a reduced ability of the drill bit to effectively penetrate the formation.

BRIEF DESCRIPTION OF THE DRAWINGS

The following figures are included to illustrate certain aspects of the present disclosure, and should not be viewed as exclusive embodiments. The subject matter disclosed is capable of considerable modifications, alterations, combinations, and equivalents in form and function, without departing from the scope of this disclosure.

DETAILED DESCRIPTION

The present disclosure relates to earth-penetrating drill bits and, more particularly, to rolling cutters that can be used in drill bits.

The rolling cutter assemblies described herein include a rolling cutter rotatably secured within a corresponding cutter pocket. A rolling cutter is able to rotate within a cutter pocket as a drill bit contacts the formation. Rotation of the rolling cutter allows its cutting surface to cut the formation using the entire outer edge (i.e., the entire circumferential edge) of the cutting surface, rather than the same section of the outer edge. As a result, more uniform edge wear may be generated and the cutter may not wear as quickly. Rolling cutters are retained within the cutter pocket using various configurations and designs of retention mechanisms that allow the rolling cutter to rotate while simultaneously preventing the rolling cutter from being dislodged from the cutter pocket.

The presently described rolling cutters may include a bearing element disposed at the bottom of the cutter pocket. The bearing element may prove advantageous in providing a low friction surface for the rolling cutter to engage while rotating. The bearing element may either be brazed into the cutter pocket or cast into the cutter pocket while fabricating the drill bit that is configured to use the rolling cutter. The bearing element may help mitigate galling of the back surface of the cutter pocket, which could potentially seize the free rotation of the rolling cutter. In some applications, a rear bearing surface may be positioned on the rolling cutter to engage the bearing element during operation. Incorporation of the rear bearing surface may provide a near-frictionless interface between the two components with a diamond-on-diamond engagement.

Figure 1A:
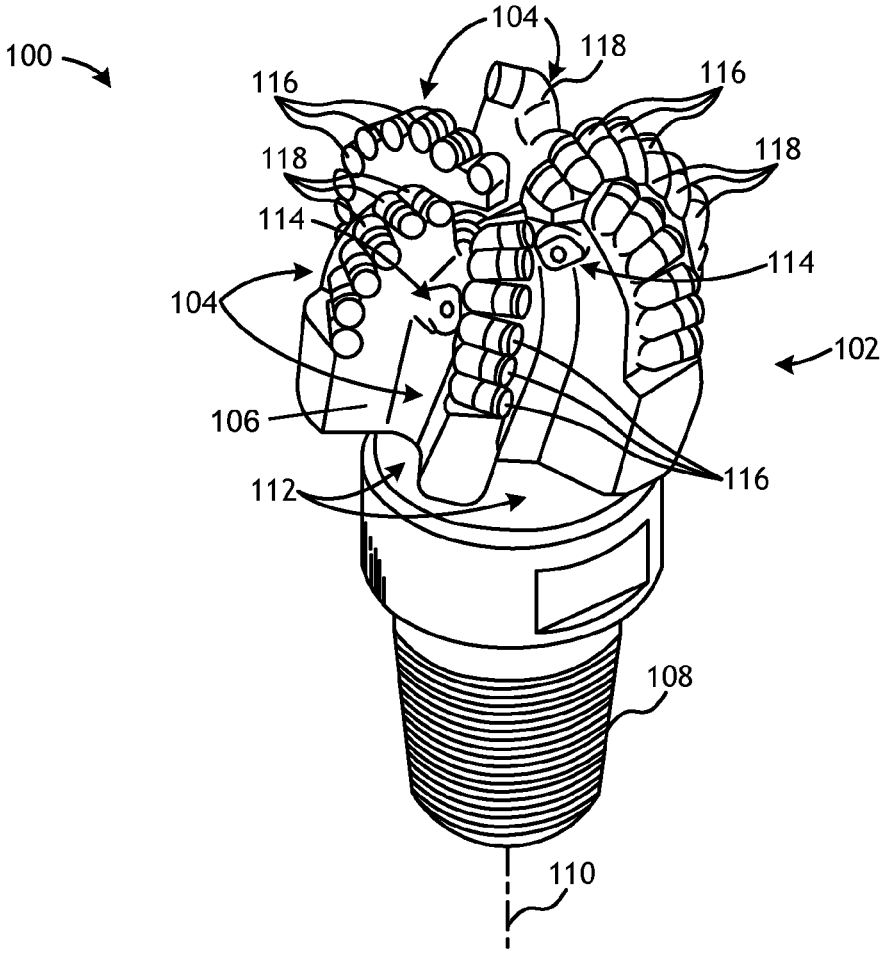
FIG. 1A is a schematic drawing of an exemplary fixed-cutter drill bit that may employ the principles of the present disclosure.

Referring to FIG. 1A, illustrated is an exemplary fixed-cutter drill bit 100 that may employ the principles of the present disclosure. The drill bit 100 has a bit body 102 that includes radially and longitudinally extending blades 104 having leading faces 106, and a threaded pin connection 108 for connecting the bit body 102 to a drill string (not shown). The bit body 102 may be made of steel or a matrix of a harder material, such as tungsten carbide.

The bit body 102 is configured for rotation about a longitudinal axis 110 to drill into a subterranean formation via application of weight-on-bit. Corresponding junk slots 112 are defined between circumferentially adjacent blades 104, and a plurality of nozzles or ports 114 can be arranged within the junk slots 112 for ejecting drilling fluid that cools the drill bit 100 and otherwise flushes away cuttings and debris generated while drilling.

The bit body 102 further includes a plurality of cutters 116 disposed within a corresponding plurality of cutter pockets 118 sized and shaped to receive the cutters 116. The cutter(s) 116 are held in the blades 104 and cutter pockets 118 at predetermined angular orientations and radial locations to present the cutters 116 with a desired backrake angle against the formation being penetrated. As the drill string is rotated, the cutters 116 are driven through the rock by the combined forces of the weight-on-bit and the torque experienced at the drill bit 100.

Figure 1B:
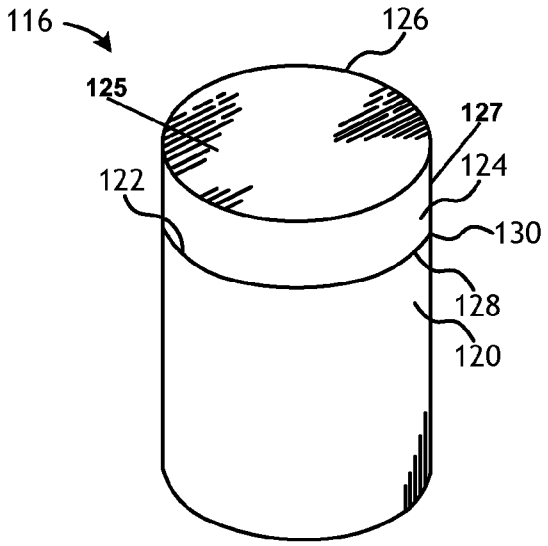
FIG. 1B is a schematic drawing of an exemplary cutter that may be used with the drill bit of FIG. 1A.

Referring now to FIG. 1B, with continued reference to FIG. 1A, illustrated is a cutter 116 that may be used with the drill bit 100 of FIG. 1A. As illustrated, the cutter 116 may include a generally cylindrical substrate 120 made of an extremely hard material, such as tungsten carbide (WC). A diamond table (alternately referred to as a disk) 124 is coupled to the substrate 120 at an interface surface 122. The diamond table 124 may include one or more layers of an ultra-hard material, such as polycrystalline diamond (PCD), polycrystalline cubic boron nitride, or impregnated diamond (other super-abrasive materials). The diamond table 124 will commonly comprises polycrystalline diamond formed from particulate material in a press at extremely high temperature and pressure. For example, the diamond table 124 may be formed and bonded to the substrate 120 in one or more high-temperature, high-pressure (HTHP) press cycles. In another example, the diamond table 124 may be formed in a first HTHP press cycle, and then bonded to the substrate 120 in a second HTHP press cycle. A catalyst material, such as cobalt, may be embedded in the substrate 120 and/or included with the particulate material, to promote bonding between diamond particles during formation of the diamond table 124, as well as bonding of the diamond table 124 to the substrate 120. The diamond table 124 generally defines a working surface, at least a portion of which engages the formation during drilling for cutting/failing the formation. The working surface may comprise a top 125, a cutting edge 126, and a side 127 of the diamond table 124. In some embodiments, the cutting edge 126 may be chamfered.

More specifically, the diamond table 124 may be described as having a "bottom" surface 128 at which the diamond table 124 is bonded to an "upper" surface 122 of the substrate 120. The bottom surface 128 and the upper surface 122 are herein collectively referred to as an interface 130, and the exposed surface of the diamond table 124 is opposite the bottom surface 128. The diamond table 124 typically has a flat or planar working surface, but may also have a curved exposed surface, that meets the side surface at the cutting edge 126.

While the cutter 116 can be formed using a cylindrical tungsten carbide "blank" as the substrate 120, which is sufficiently long to act as a mounting stud for the diamond table 124, the substrate 120 may, in another example, be an intermediate layer bonded at another interface to another metallic mounting stud. To form the diamond table 124, the substrate 120 is placed adjacent a layer of ultra-hard material particles, such as diamond or cubic boron nitride particles, and the combination is subjected to high temperature at a pressure where the ultra-hard material particles are thermodynamically stable. This results in recrystallization and formation of a polycrystalline ultra-hard material layer, such as a polycrystalline diamond or polycrystalline cubic boron nitride layer, directly onto the upper surface 122 of the substrate 120. When using polycrystalline diamond as the ultra-hard material, the cutter 116 may be referred to as a polycrystalline diamond compact cutter or a "PDC cutter," and drill bits made using such PDC cutters 116 are generally known as PDC bits.

According to the present disclosure, one or more of the cutters 116 in the drill bit 100 of FIG. 1A may be a rolling cutter. As the cutter 116 contacts the underlying formation, shearing of the formation may urge the cutter 116 to rotate about its central axis. Rotation of the cutter 116 may allow the diamond table 124 to engage the underlying formation using the entire circumference of the cutting edge 126, rather than the same section of the cutting edge 126. As will be appreciated, this may generate a more uniform edge wear on the cutter 116, and thereby prevent the formation of a local wear flat area on the diamond table 124. As a result, the cutter 116 may not wear as quickly in one region and thereby exhibit longer downhole life and increased efficiency of the drilling operation.

The rolling cutters according to the present disclosure can be retained within corresponding cutter pockets 118 using various configurations of a retention mechanism and a bearing element may be disposed at the bottom of the cutter pocket 118. The bearing element may prove advantageous in providing a low friction surface for the cutter 116 to rotate on, without which, the cutter 116 may gall the back surface of the cutter pocket 118 and potentially seize free rotation of the cutter 116.

Figure 2:
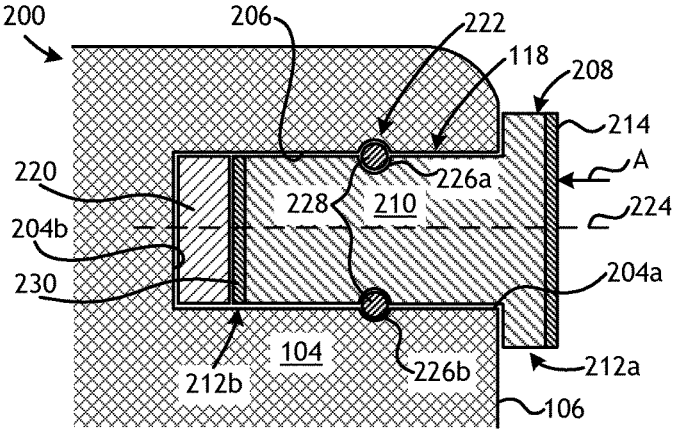
FIG. 2 is a cross-sectional top view of an exemplary rolling cutter assembly.

Referring now to FIG. 2, with continued reference to FIG. 1A, illustrated is a cross-sectional top view of an exemplary rolling cutter assembly 200, according to one or more embodiments. The rolling cutter assembly 200 (hereafter "assembly 200") may be employed in the drill bit 100 of FIG. 1A and therefore may be best understood with reference thereto, where like numerals represent like components or elements not described again in detail. It should be noted, however, that while described herein as being used in conjunction with the drill bit 100, those skilled in the art will readily appreciate that the assembly 200 may equally be employed in a variety of other types of drill bits or cutting tools, without departing from the scope of the disclosure. For example, other cutting tools that may benefit from the embodiments described herein include, but are not limited to, impregnated drill bits, core heads, coring tools, reamers (e.g., hole enlargement tools), and other known downhole drilling tools.

As illustrated, the assembly 200 may be coupled to and otherwise associated with a blade 104 of the drill bit 100. In other embodiments, however, the assembly 200 may be coupled to any other static component of the drill bit 100, without departing from the scope of the disclosure. For instance, in at least one embodiment, the assembly 200 may be coupled to the top of a blade 104 of the drill bit 100 or in a backup row. The leading face 106 of the blade 104 faces in the general direction of rotation for the blade 104. A cutter pocket 118 may be formed in the blade 104 at the leading face of the blade 104. The cutter pocket 118 may include or otherwise provide a receiving end 204*a*, a bottom end 204*b*, and a sidewall 206 that extends between the receiving and bottom ends 204*a,b*.

The assembly 200 may further include a generally cylindrical rolling cutter 208 configured to be disposed within the cutter pocket 118. The receiving end 204*a* may define a generally cylindrical opening configured to receive the rolling cutter 208 into the cutter pocket 118. The rolling cutter 208 may include a substrate 210 that provides a first end 212*a* and a second end 212*b*. As illustrated, the first end 212*a* may extend out of the cutter pocket 118 a short distance, and the second end 212*b* may be configured to be arranged within the cutter pocket 118 at or near the bottom end 204*b*.

The substrate 210 may be formed of a variety of hard or ultra-hard materials including, but not limited to, steel, steel alloys, tungsten carbide, cemented carbide, and any derivatives and combinations thereof. Suitable cemented carbides may contain varying proportions of titanium carbide (TiC), tantalum carbide (TaC), and niobium carbide (NbC). Additionally, various binding metals may be included in the substrate 210, such as cobalt, nickel, iron, metal alloys, or mixtures thereof. In the substrate 210, the metal carbide grains are supported within a metallic binder, such as cobalt. In other cases, the substrate 210 may be formed of a sintered tungsten carbide composite structure or a diamond ultra-hard material, such as polycrystalline diamond or thermally stable polycrystalline diamond.

A diamond table 214 may be disposed on the substrate 210 at the first end 212*a*. The diamond table 214 may be similar to the diamond table 124 of FIG. 1B and, therefore, may be configured to engage and cut through underlying subterranean formations during drilling operations. The diamond table 214 may be made of a variety of ultra-hard materials including, but not limited to, polycrystalline diamond (PCD), thermally stable polycrystalline diamond (TSP), cubic boron nitride, impregnated diamond, nanocrystalline diamond, and ultra-nanocrystalline diamond. While the illustrated embodiments show the diamond table 214 and the substrate 210 as two distinct components of the rolling cutter 208, those skilled in the art will readily appreciate that the diamond table 214 and the substrate 210 may alternatively be integrally formed and otherwise made of the same materials, without departing from the scope of the disclosure.

The assembly 200 may further include a bearing element 220 arranged within the cutter pocket 118 at the bottom end 204*b*. During operation of the drill bit that houses the rolling cutter 208 (e.g., the drill bit 100 of FIG. 1A), the second end 212*b* of the rolling cutter 208 (e.g., the substrate 210) may be configured to engage the bearing element 220 as the rolling cutter 208 rotates. In some embodiments, the bearing element 220 may be brazed into the bottom end 204*b* of the cutter pocket 118. In other embodiments, however, the bearing element 220 may be cast directly into the bottom end 204*b* of the cutter pocket 118. In at least one embodiment, the bearing element 220 may be secured into the bottom end 204*b* of the cutter pocket 118 by using a dovetail-like retention mechanism.

More specifically, the drill bit 100 (FIG. 1A) may be fabricated through a casting process that uses a mold (not shown) that includes and otherwise contains all the necessary materials and component parts required to produce the drill bit 100 including, but not limited to, reinforcement materials, a binder material, displacement materials, a bit blank, etc. The blade 104 and the cutter pocket 118 may be defined or otherwise formed using the mold and various sand displacements. Prior to undertaking the casting process to form the drill bit 100, the bearing element 220 may be secured to the mold such that it is located at the bottom end 204*b* of the cutter pocket 118.

For some applications, two or more different types of matrix reinforcement materials or powders may be disposed within the mold to cast the drill bit 100. Examples of such matrix reinforcement materials may include, but are not limited to, tungsten carbide, monotungsten carbide (WC), ditungsten carbide ($W_2C$), macrocrystalline tungsten carbide, other metal carbides, metal borides, metal oxides, metal nitrides, natural and synthetic diamond, and polycrystalline diamond (PCD). Examples of other metal carbides may include, but are not limited to, titanium carbide and tantalum carbide, and various mixtures of such materials may also be used. Various binder (infiltration) materials that may be used include, but are not limited to, metallic alloys of copper (Cu), nickel (Ni), manganese (Mn), lead (Pb), tin (Sn), cobalt (Co), silver (Ag), and any derivatives and combinations thereof. Phosphorous (P) may sometimes also be added in small quantities to reduce the melting temperature range of infiltration materials disposed in the mold. Various mixtures of such metallic alloys may also be used as the binder material.

The mold may then be placed within a furnace to elevate the temperature of the mold and its contents and thereby liquefy the binder material so that it is able to infiltrate the matrix material and generate a molten metal matrix. As the molten metal matrix flows into the area of the mold containing the blade 104 and the cutter pocket 118, the molten metal may flow partially around the bearing element 220 and thereby secure the bearing element 220 within the cutter pocket 118 at the bottom end 204*b*. The molten metal may flow to bind the powder metal, thus forming a solid structural body that retains the bearing element 220. In some embodiments, the molten metal forms a bond with the material of the bearing element 220. Accordingly, in at least one embodiment, the bearing element 220 may be integrally formed with the drill bit 100 and, more particularly, within the cutter pocket 118 at the bottom end 204*b*.

The bearing element 220 may be made of an ultra-hard material, such as a material capable of surviving the molding or casting process used to fabricate the drill bit 100. Suitable materials for the bearing element 220 include, but are not limited to, TSP, PCD, cubic boron nitride, impregnated diamond, nanocrystalline diamond, ultra-nanocrystalline diamond, silicon nitride ($Si_3N_4$), chrome steel, stainless steel, carbon alloy steel, ceramics, and ceramic hybrids including silicon, alumina, zirconia, and any derivatives and combinations thereof. In at least one embodiment, the bearing element 220 may be made of TSP, which has a thermal stability that is greater than that of conventional PCD (i.e., approximately 750° C.) and may be formed in various ways. For instance, a typical PCD layer includes individual diamond "crystals" that are interconnected and thereby form a bonded structure. A metal catalyst, such as cobalt, may be used to promote recrystallization of the diamond particles and formation of the bonded structure. Thus, cobalt particles are typically found within the interstitial spaces in the diamond bonded structure. Cobalt has a significantly different coefficient of thermal expansion as compared to diamond and, therefore, expands at a different rate than the diamond bond upon heating the diamond table. This can cause cracks to form in the bonded structure and result in deterioration of the diamond table.

To avoid creating such cracks in the bonded structure, strong acids are commonly used to leach the cobalt from the PCD bonded structure (either a thin volume or entire tablet) to at least reduce the damage experienced from heating the diamond-cobalt composite at different rates. Briefly, a strong acid may be used to treat the diamond table and thereby remove at least a portion of the co-catalyst from the PCD bonded structure. Suitable acids include nitric acid, hydrofluoric acid, hydrochloric acid, sulfuric acid, phosphoric acid, perchloric acid, or any combination thereof. In addition, caustics, such as sodium hydroxide and potassium hydroxide, have been used to digest metallic elements from carbide composites. By leaching out the cobalt, TSP may be formed, or otherwise by post processing in which the coefficient of thermal expansion of the catalyst is lowered.

Alternatively, TSP may be formed by generating the diamond layer in a press using a binder other than cobalt, such as silicon, which has a coefficient of thermal expansion more similar to that of diamond. During this process, the silicon reacts with the diamond bond to form silicon carbide, which also exhibits a thermal expansion similar to that of diamond. Upon heating, any remaining silicon or silicon carbide and the diamond bond will expand at rates comparable to the rates of expansion for cobalt and diamond, and thereby resulting in a more thermally stable layer.

The assembly 200 may further include a retention mechanism 222 configured to secure the rolling cutter 208 within the cutter pocket 118. The retention mechanism 222 may be any device or mechanism configured to allow the rolling cutter 208 to rotate about its central axis 224 within the cutter pocket 118 while simultaneously preventing removal thereof from the cutter pocket 118. In some embodiments, as illustrated, the retention mechanism 222 may be a ball bearing system that includes an inner bearing race 226*a*, an outer bearing race 226*b*, and one or more ball bearings 228 (two shown) disposed within the inner and outer bearing races 226*a,b*. The inner bearing race 226*a* may be defined on the outer surface of the rolling cutter 208 (i.e., the outer surface of the substrate 210), and the outer bearing race 226*b* may be defined on the inner radial surface of the sidewall 206 of the cutter pocket 118. In some embodiments, the outer bearing race 226*b* may be formed in the sidewall 206 during the casting process described above, such as through strategic placement of sand displacements. In other embodiments, however, the outer bearing race 226*b* may be formed on the inner radial surface of the sidewall 206 following the casting process, such as by milling or grinding the outer bearing race 226*b* into the inner radial surface of the sidewall 206. Indeed, the outer bearing race 226*b* may be formed by any material displacement or removal process known to those skilled in the art.

When the rolling cutter 208 is properly installed in the cutter pocket 118, the inner and outer bearing races 226*a,b* may be substantially aligned, and the space defined between inner and outer bearing races 226*a,b* may be generally occupied by the ball bearings 228. The ball bearings 228 may be made of any material capable of withstanding compressive forces acting thereupon while the rolling cutter 208 engages the underlying subterranean formation. In some embodiments, for example, the ball bearings 228 may be made of steel, a steel alloy, carbide (e.g., tungsten carbide, silicon carbide, etc.), or any combination thereof. The ball bearings 228 may exhibit any size capable of traversing and otherwise rolling within the inner and outer bearing races 226*a,b*.

While described herein as a ball bearing system, those skilled in the art will readily appreciate that the retention mechanism 222 may alternatively comprise any other device or mechanism that allows the rolling cutter 208 to rotate while simultaneously preventing its removal from the cutter pocket 118. For example, in other embodiments, the retention mechanism 222 may otherwise include or otherwise encompass one or more pins or a mechanical interlocking device that rotatably secures the rolling cutter 208 within the cutter pocket 118. Moreover, it will further be appreciated that multiple retention mechanisms 222 may also be used, without departing from the scope of the disclosure.

In exemplary drilling operation, the rolling cutter 208 may be configured to engage an underlying subterranean formation. As the rolling cutter 208 contacts the underlying formation, the formation begins to shear and generates an opposing force that is assumed on the diamond table 214 in the direction A. Moreover, shearing of the formation may urge the rolling cutter 208 to rotate about the central axis 224. The opposing force in the direction A may be transmitted to the second end 212*b* of the rolling cutter 208 (e.g., the substrate 210), which engages the bearing element 220. Since the bearing element 220 is made of an ultra-hard material, such as TSP, the second end 212*b* may slidingly engage the bearing element 220, without which, the second end 212*b* could potentially gall the bottom end 204*b* end of the cutter pocket 118. With the bearing element 220, however, friction between the cutter pocket 118 and the second end 212*b* of the rolling cutter 208 may be dramatically reduced, thereby also decreasing the amount of heat generated during drilling. As a result, it will require less force to urge the rolling cutter 208 to rotate, and a drilling operator may be able to apply more force against the rolling cutter 208 in the direction A, and thereby increase the efficiency of the drilling operation.

As will be appreciated, any amount of force or energy that goes into rotating the rolling cutter 208 is force that is not used to cut through the underlying formation. Consequently, there is a slight loss of efficiency, and hence the desire to reduce the amount of force required to rotate the rolling cutter 208. Any minor losses in drilling efficiency are more than offset by the benefit of the presently described assembly 200 and rolling cutter 208 in that then the entire circumferential edge of the rolling cutter 208 can be used throughout the run resulting in a cutter that remains sharp longer.

Moreover, in some embodiments, the assembly 200 may further include a rear bearing surface 230 disposed on the second end 212*b* of the substrate 210. Similar to the diamond table 214, the rear bearing surface 230 may be made of a variety of ultra-hard materials including, but not limited to, PCD, TSP, cubic boron nitride, impregnated diamond, nanocrystalline diamond, and ultra-nanocrystalline diamond. The rear bearing surface 230 may interpose the substrate 210 and the bearing element 220 and thereby provide a near-frictionless interface between the two components with a diamond-on-diamond engagement.

Figure 3:
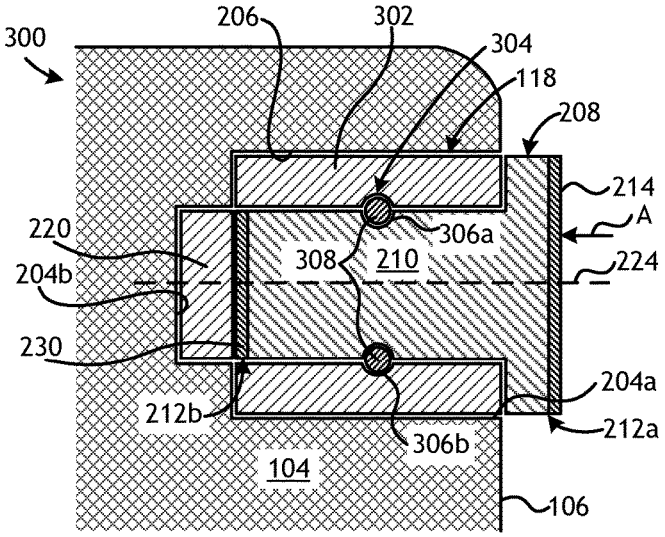
FIG. 3 is a cross-sectional top view of another exemplary rolling cutter assembly.

Referring now to FIG. 3, with continued reference to FIG. 2, illustrated is a cross-sectional top view of another exemplary rolling cutter assembly 300, according to one or more embodiments. The rolling cutter assembly 300 (hereafter "assembly 300") may be similar to the assembly 200 of FIG. 2 and therefore may be best understood with reference thereto, where like numerals represent like components or elements not described again in detail. Similar to the assembly 200, the assembly 300 may also be employed in the drill bit 100 of FIG. 1A, but may equally be employed in other types of drill bits, without departing from the scope of the disclosure.

As illustrated, the assembly 300 may be configured to be coupled to and otherwise associated with the cutter pocket 118 defined within the blade 104 of a drill bit (e.g., the drill bit 100 of FIG. 1A). Moreover, the assembly 300 may further include the rolling cutter 208 configured to be rotatably disposed within the cutter pocket 118 and, more particularly, received within the receiving end 204*a* of the cutter pocket 118 and extended therein such that the second end 212*b* of the rolling cutter 208 is arranged at or near the bottom end 204*b*. The assembly 300 may also include the bearing element 220 arranged within the cutter pocket 118 at the bottom end 204*b*. As with the assembly 200, the bearing element 220 may be brazed into the bottom end 204*b* of the cutter pocket 118 or may alternatively be cast directly into the bottom end 204*b* of the cutter pocket 118 during fabrication of the drill bit 100, as described above. Accordingly, in at least one embodiment, the bearing element 220 in the assembly 300 may be integrally formed with and otherwise within the cutter pocket 118.

Unlike the assembly 200, however, the assembly 300 may further include a sleeve 302 disposed within the cutter pocket 118 and interposing the sidewall 206 of the cutter pocket 118 and the rolling cutter 208. The sleeve 302 may be immovably secured to the sidewall 206 for long-term operation. In one embodiment, for example, the sleeve 302 may be brazed to the sidewall 206. In other embodiments, however, the sleeve 302 may be cast into the cutter pocket 118, similar to the process of casting the bearing element 220 into the cutter pocket 118 described above.

In some embodiments, the sleeve 302 may be a monolithic, cylindrical structure. In other embodiments, the sleeve 302 may comprise two or more arcuate sections that extend about the circumference of the cutter pocket 118 about the periphery of the sidewall 206. The sleeve 302 may be made of a variety of materials including, but not limited to, steel, a steel alloy, carbides (e.g., tungsten carbide), cemented carbides, and any combination thereof. Suitable cemented carbides may contain varying proportions of titanium carbide (TiC), tantalum carbide (TaC), and niobium carbide (NbC).

The assembly 300 may further include a retention mechanism 304 configured to secure the rolling cutter 208 within the cutter pocket 118. The retention mechanism 304 may be similar to the retention mechanism 222 of FIG. 2 and, therefore, may include any device or mechanism configured to allow the rolling cutter 208 to rotate about the central axis 224 within the cutter pocket 118 while simultaneously preventing removal thereof from the cutter pocket 118. Similar to the retention mechanism 222, the retention mechanism 304 may be a ball bearing system. In other embodiments, however, the retention mechanism 304 may include one or more pins or a mechanical interlocking device that rotatably secures the rolling cutter 208 within the cutter pocket 118.

In the illustrated embodiment, the retention mechanism 304 includes an inner bearing race 306*a*, an outer bearing race 306*b*, and one or more ball bearings 308 (two shown). The inner bearing race 306*a* may be defined on the outer surface of the rolling cutter 208 (i.e., the outer surface of the substrate 210), and the outer bearing race 306*b* may be defined on an inner radial surface of the sleeve 302. When the rolling cutter 208 is properly installed in the cutter pocket 118, the inner and outer bearing races 306*a,b* may be substantially aligned, and the space defined between inner and outer bearing races 306*a,b* may be generally occupied by the ball bearings 308. The ball bearings 308 may be similar to the ball bearings 228 of FIG. 2 and, therefore, will not be described again.

In exemplary drilling operation using the assembly 300, the rolling cutter 208 may be configured to engage an underlying subterranean formation, thereby generating an opposing force assumed on the diamond table 214 in the direction A as the diamond table 214 shears the formation. The opposing force in the direction A may be transmitted to the second end 212*b* of the rolling cutter 208 (e.g., the substrate 210), which engages the bearing element 220. Since the bearing element 220 is made of an ultra-hard material, such as TSP, the second end 212*b* may slidingly engage the bearing element 220, which dramatically reduces the friction between the cutter pocket 118 and the rolling cutter 208. As a result, it will require less force to urge the rolling cutter 208 to rotate, and a drilling operator may be able to apply more force against the rolling cutter 208 in the direction A, and thereby increase the efficiency of the drilling operation. Moreover, similar to the assembly 200, in some embodiments, the assembly 300 may also include the rear bearing surface 230 provided on the second end 212*b* of the rolling cutter 208, and thereby provide a near-frictionless interface between the two components.

Figure 4:
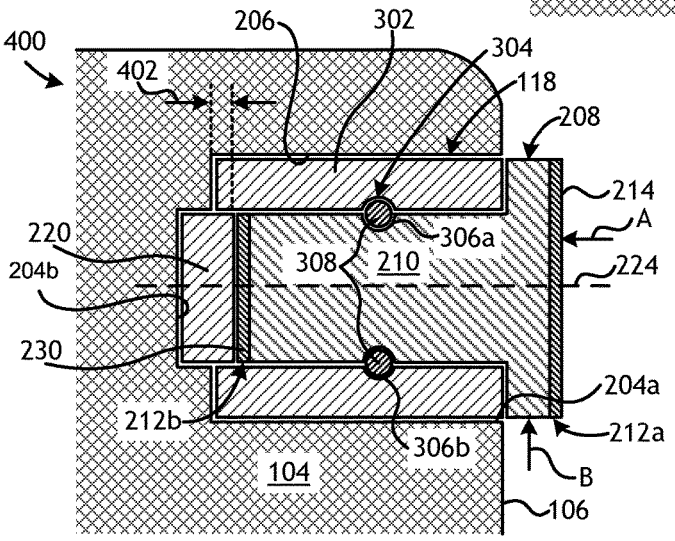
FIG. 4 is a cross-sectional top view of another exemplary rolling cutter assembly.

Referring now to FIG. 4, with continued reference to FIG. 3, illustrated is a cross-sectional top view of another exemplary rolling cutter assembly 400, according to one or more embodiments. The rolling cutter assembly 400 (hereafter "assembly 400") may be similar to the assembly 300 of FIG. 3 and therefore may be best understood with reference thereto, where like numerals represent like components or elements not described again. Similar to the assembly 300, the assembly 400 may be employed in the drill bit 100 of FIG. 1A, but may equally be employed in a variety of other types of drill bits, without departing from the scope of the disclosure.

As illustrated, the assembly 400 may be configured to be coupled to and otherwise associated with the cutter pocket 118 defined within the blade 104 of a drill bit (e.g., the drill bit 100 of FIG. 1A). Moreover, the assembly 400 may further include the rolling cutter 208 configured to be rotatably disposed within the cutter pocket 118 and, more particularly, received within the receiving end 204*a* of the cutter pocket 118 and extended therein such that the second end 212*b* of the rolling cutter 208 is arranged at or near the bottom end 204*b*. The assembly 400 may further include the sleeve 302 and the retention mechanism 304, as described above with reference to the assembly 300 of FIG. 3.

Similar to the assembly 300, the assembly 400 may also include the bearing element 220 arranged within the cutter pocket 118 at the bottom end 204*b*. Again, the bearing element 220 may be brazed into the bottom end 204*b* of the cutter pocket 118 or may alternatively be cast directly into the bottom end 204*b* during fabrication of the drill bit 100 (FIG. 1A), as described above. Accordingly, in at least one embodiment, the bearing element 220 in the assembly 400 may be integrally formed with and otherwise within the cutter pocket 118.

Unlike the assembly 300, however, the bearing element 220 in the assembly 400 may protrude a short distance 402 into the cutter pocket 118 from the bottom end 204*b* such that it may extend at least partially into the interior of the sleeve 302. Accordingly, the bearing element 220 may form a pedestal-like structure that axially overlaps a portion of the interior of the sleeve 302 corresponding to the distance 402. In some embodiments, the sleeve 302 may be inserted into the cutter pocket 118, extended around the protruding bearing element 220, and subsequently brazed in place within the cutter pocket 118.

As will be appreciated by those skilled in the art, having the bearing element 220 protrude from the bottom end 204*b* of the cutter pocket 118 such that it extends into the interior of the sleeve 302 may prove advantageous. For instance, as extended into the interior of the sleeve 302, the bearing element 220 may provide a mechanical retention mechanism for the sleeve 302. More particularly, drilling may result in the generation of lateral cutting forces assumed on the rolling cutter 208 in the direction B, and such lateral cutting forces can be transmitted to the sleeve 302. Unless properly mitigated, the lateral cutting forces may tend to urge or pry the sleeve 302 out of the cutter pocket 118. With the bearing element 220 extended into the sleeve 302 to at least the distance 402, however, the outer radial surface of the bearing element 220 may axially overlap corresponding inner portions of the sleeve 302 and thereby generate a mechanical lock that prevents the sleeve 302 from being pried out of the cutter pocket 118.

In some embodiments, as illustrated, the assembly 400 may further include the rear bearing surface 230 provided on the second end 212*b* of the rolling cutter 208, and thereby provide a near-frictionless interface between the rolling cutter 208 and the cutter pocket 118. Exemplary drilling operation using the assembly 400 may be substantially similar to the assembly 300 and, therefore, will not be repeated.

Embodiments disclosed herein include:

A. A rolling cutter assembly that includes a rolling cutter disposable within a cutter pocket defined in a drill bit, the cutter pocket including a receiving end, a bottom end, and a sidewall extending between the receiving and bottom ends, and the rolling cutter providing a substrate having a first end with a diamond table disposed thereon and a second end arrangeable within the cutter pocket at or near the bottom end, and a bearing element disposable within the cutter pocket at the bottom end and engageable with the second end of the rolling cutter as the rolling cutter rotates about a central axis.

B. A drill bit that includes a bit body, at least one blade extending radially from the bit body, at least one cutter pocket defined in the at least one blade and including a receiving end, a bottom end, and a sidewall extending between the receiving and bottom ends, a bearing element disposed within the at least one cutter pocket at the bottom end, and at least one rolling cutter arranged within the at least one cutter pocket and providing a substrate that has a first end with a diamond table disposed thereon and a second end arrangeable within the cutter pocket at or near the bottom end such that the second end is engageable with the bearing element as the at least one rolling cutter rotates about a central axis.

C. A method of fabricating a drill bit that includes forming a bit body that includes at least one blade and at least one cutter pocket defined in the at least one blade, the at least one cutter pocket including a receiving end, a bottom end, and a sidewall extending between the receiving and bottom ends, securing a bearing element within the at least one cutter pocket at the bottom end, arranging a rolling cutter in the at least one cutter pocket, the rolling cutter providing a substrate having a first end and a second end, the first end having a diamond table disposed thereon, and arranging the second end within the at least one cutter pocket adjacent the bearing element such that the second end is engageable with the bearing element as the rolling cutter rotates about a central axis.

Each of embodiments A, B, and C may have one or more of the following additional elements in any combination: Element 1: wherein the diamond table comprises a material selected from the group consisting of polycrystalline diamond, thermally stable polycrystalline diamond, cubic boron nitride, impregnated diamond, nanocrystalline diamond, and ultra-nanocrystalline diamond. Element 2: wherein the bearing element is brazed into the bottom end of the cutter pocket. Element 3: wherein the bearing element is cast into the bottom end of the cutter pocket. Element 4: wherein the bearing element comprises a material selected from the group consisting of polycrystalline diamond, thermally stable polycrystalline diamond, cubic boron nitride, impregnated diamond, nanocrystalline diamond, ultra-nanocrystalline diamond, silicon nitride, chrome steel, stainless steel, carbon alloy steel, ceramics, and ceramic hybrids including silicon, alumina, and zirconia. Element 5: further comprising a retention mechanism that rotatably secures the rolling cutter within the cutter pocket, the retention mechanism comprising an inner bearing race defined on an outer surface of the substrate, an outer bearing race defined on the sidewall of the cutter pocket, and one or more ball bearings disposable within the inner and outer bearing races upon axially aligning the inner and outer bearing races. Element 6: wherein the outer bearing race is cast into the sidewall of the cutter pocket. Element 7: further comprising a rear bearing surface disposed on the second end of the rolling cutter and engageable with the bearing element as the rolling cutter rotates about the central axis, the rear bearing surface comprising a material selected from the group consisting of polycrystalline diamond, thermally stable polycrystalline diamond, cubic boron nitride, impregnated diamond, nanocrystalline diamond, and ultra-nanocrystalline diamond. Element 8: further comprising a sleeve securable to the sidewall of the cutter pocket, the sleeve being at least one of brazed to the sidewall and cast into the cutter pocket. Element 9: further comprising a retention mechanism that rotatably secures the rolling cutter within the cutter pocket, the retention mechanism comprising an inner bearing race defined on an outer surface of the substrate, an outer bearing race defined in the sleeve, and one or more ball bearings disposable within the inner and outer bearing races upon axially aligning the inner and outer bearing races. Element 10: wherein the bearing element protrudes from the bottom end of the cutter pocket and extends into an interior of the sleeve.

Element 11: wherein the bearing element is at least one of brazed into the bottom end of the cutter pocket. Element 12: wherein the bearing element is cast into the bottom end of the cutter pocket. Element 13: further comprising a rear bearing surface disposed on the second end of the rolling cutter and engageable with the bearing element as the rolling cutter rotates about the central axis, the rear bearing surface comprising a material selected from the group consisting of polycrystalline diamond, thermally stable polycrystalline diamond, cubic boron nitride, impregnated diamond, nanocrystalline diamond, and ultra-nanocrystalline diamond. Element 14: further comprising a sleeve arranged within the at least one cutter pocket, wherein the sleeve is at least one of brazed to the sidewall and cast into the cutter pocket. Element 15: wherein the bearing element protrudes from the bottom end of the at least one cutter pocket and extends a distance into an interior of the sleeve.

Element 16: wherein securing the bearing element within the at least one cutter pocket at the bottom end comprises casting the bearing element into the bottom end of the at least one cutter pocket. Element 17: further comprising rotatably securing the rolling cutter within the at least one cutter pocket with a retention mechanism, the retention mechanism including an inner bearing race defined on an outer surface of the substrate, an outer bearing race cast into the sidewall of the at least one cutter pocket, and one or more ball bearings disposable within the inner and outer bearing races upon axially aligning the inner and outer bearing races. Element 18: wherein arranging the second end within the at least one cutter pocket adjacent the bearing element further comprises arranging a rear bearing surface disposed on the second end of the rolling cutter adjacent the bearing element such that the rear bearing surface engages the bearing element as the rolling cutter rotates about the central axis. Element 19: further comprising securing a sleeve to the sidewall of the at least one cutter pocket. Element 20: further comprising rotatably securing the rolling cutter within the at least one cutter pocket with a retention mechanism, the retention mechanism including an inner bearing race defined on an outer surface of the substrate, an outer bearing race cast into the sidewall of the at least one cutter pocket, and one or more ball bearings disposable within the inner and outer bearing races upon axially aligning the inner and outer bearing races. Element 21: wherein securing the bearing element within the at least one cutter pocket comprises arranging the bearing element in the at least one cutter pocket such that the bearing element protrudes from the bottom end and extends into an interior of the sleeve.

Therefore, the disclosed systems and methods are well adapted to attain the ends and advantages mentioned as well as those that are inherent therein. The particular embodiments disclosed above are illustrative only, as the teachings of the present disclosure may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered, combined, or modified and all such variations are considered within the scope of the present disclosure. The systems and methods illustratively disclosed herein may suitably be practiced in the absence of any element that is not specifically disclosed herein and/or any optional element disclosed herein. While compositions and methods are described in terms of "comprising," "containing," or "including" various components or steps, the compositions and methods can also "consist essentially of" or "consist of" the various components and steps. All numbers and ranges disclosed above may vary by some amount. Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the element that it introduces. If there is any conflict in the usages of a word or term in this specification and one or more patent or other documents that may be incorporated herein by reference, the definitions that are consistent with this specification should be adopted.

As used herein, the phrase "at least one of" preceding a series of items, with the terms "and" or "or" to separate any of the items, modifies the list as a whole, rather than each member of the list (i.e., each item). The phrase "at least one of" allows a meaning that includes at least one of any one of the items, and/or at least one of any combination of the items, and/or at least one of each of the items. By way of example, the phrases "at least one of A, B, and C" or "at least one of A, B, or C" each refer to only A, only B, or only C; any combination of A, B, and C; and/or at least one of each of A, B, and C.

What is claimed is:

1. A rolling cutter assembly, comprising:

a rolling cutter disposable within a cutter pocket of a drill bit, the cutter pocket including a receiving end, a bottom end, and a sidewall extending between the receiving and bottom ends, and the rolling cutter providing a substrate having a first end with a diamond table disposed thereon and a second end located within the cutter pocket at or near the bottom end;

a retention mechanism that rotatably secures the rolling cutter within the cutter pocket, wherein the retention mechanism includes:

an inner bearing race defined on an outer surface of the substrate;

an outer bearing race defined on the sidewall of the cutter pocket or on a sleeve securable to the sidewall of the cutter pocket; and one or more ball bearings disposable within the inner and outer bearing races upon axially aligning the inner and outer bearing races; and a bearing element bonded directly to the drill bit within the cutter pocket of the drill bit at the bottom end and engageable with the second end of the rolling cutter as the rolling cutter rotates about a central axis.

2. The rolling cutter assembly of claim 1, wherein the bearing element is at least one of brazed or cast into the bottom end of the cutter pocket.

3. The rolling cutter assembly of claim 1, wherein the bearing element comprises a material selected from the group consisting of polycrystalline diamond, thermally stable polycrystalline diamond, cubic boron nitride, impregnated diamond, nanocrystalline diamond, ultra-nanocrystalline diamond, silicon nitride, chrome steel, stainless steel, carbon alloy steel, a ceramic, and a ceramic hybrid including silicon, alumina, zirconia, and any derivatives and combinations thereof.

4. The rolling cutter assembly of claim 1, wherein the outer bearing race is cast into the sidewall of the cutter pocket.

5. The rolling cutter assembly of claim 1, further comprising a rear bearing surface disposed on the second end of the rolling cutter and engageable with the bearing element as the rolling cutter rotates about the central axis, the rear bearing surface comprising a material selected from the group consisting of polycrystalline diamond, thermally stable polycrystalline diamond, cubic boron nitride, impregnated diamond, nanocrystalline diamond, ultra-nanocrystalline diamond, and any derivatives and combinations thereof.

6. The rolling cutter assembly of claim 1, wherein the sleeve is securable to the sidewall of the cutter pocket, the sleeve being at least one of brazed to the sidewall and cast into the cutter pocket.

7. The rolling cutter assembly of claim 6, wherein the bearing element protrudes from the bottom end of the cutter pocket and extends into an interior of the sleeve.

8. A drill bit, comprising:

a bit body;

at least one blade extending radially from the bit body;

at least one cutter pocket defined in the at least one blade and including a receiving end, a bottom end, and a sidewall extending between the receiving and bottom ends;

a bearing element bonded directly to the drill bit within the at least one cutter pocket of the drill bit at the bottom end;

at least one rolling cutter arranged within the at least one cutter pocket and providing a substrate that has a first end with a diamond table disposed thereon and a second end arrangeable within the cutter pocket at or near the bottom end such that the second end is engageable with the bearing element; and a retention mechanism that rotatably secures the at least one rolling cutter within the at least one cutter pocket as the at least one rolling cutter rotates about a central axis, wherein the retention mechanism comprises:

an inner bearing race defined on an outer surface of the substrate;

an outer bearing race defined on the sidewall of the at least one cutter pocket or on a sleeve securable to the sidewall of the cutter pocket; and one or more ball bearings disposable within the inner and outer bearing races upon axially aligning the inner and outer bearing races.

9. The drill bit of claim 8, wherein the bearing element is at least one of brazed or cast into the bottom end of the cutter pocket.

10. The drill bit of claim 8, wherein the bearing element comprises a material selected from the group consisting of polycrystalline diamond, thermally stable polycrystalline diamond, cubic boron nitride, impregnated diamond, nanocrystalline diamond, ultra-nanocrystalline diamond, silicon nitride, chrome steel, stainless steel, carbon alloy steel, ceramics, and ceramic hybrids including silicon, alumina, zirconia, and any derivatives and combinations thereof.

11. The drill bit of claim 8, wherein the outer bearing race is cast into the sidewall of the at least one cutter pocket.

12. The drill bit of claim 8, further comprising a rear bearing surface disposed on the second end of the rolling cutter and engageable with the bearing element as the rolling cutter rotates about the central axis, the rear bearing surface comprising a material selected from the group consisting of polycrystalline diamond, thermally stable polycrystalline diamond, cubic boron nitride, impregnated diamond, nanocrystalline diamond, ultra-nanocrystalline diamond, and any derivatives and combinations thereof.

13. The drill bit of claim 8, wherein the sleeve is arranged within the at least one cutter pocket, wherein the sleeve is at least one of brazed to the sidewall and cast into the cutter pocket.

14. The drill bit of claim 13, wherein the bearing element protrudes from the bottom end of the at least one cutter pocket and extends a distance into an interior of the sleeve.

15. A method of fabricating a drill bit, comprising:

forming a bit body that includes at least one blade and at least one cutter pocket defined in the at least one blade, the at least one cutter pocket including a receiving end, a bottom end, and a sidewall extending between the receiving and bottom ends;

bonding a bearing element directly to the drill bit within the at least one cutter pocket of the drill bit at the bottom end;

arranging a rolling cutter in the at least one cutter pocket, the rolling cutter providing a substrate having a first end and a second end, the first end having a diamond table disposed thereon;

arranging the second end within the at least one cutter pocket adjacent the bearing element such that the second end is engageable with the bearing element as the rolling cutter rotates about a central axis; and rotatably securing the rolling cutter within the at least one cutter pocket with a retention mechanism, the retention mechanism including an inner bearing race defined on an outer surface of the substrate, an outer bearing race defined on the sidewall of the at least one cutter pocket or on a sleeve securable to the sidewall of the at least one cutter pocket, and one or more ball bearings disposable within the inner and outer bearing races upon axially aligning the inner and outer bearing races.

16. The method of claim 15, wherein bonding the bearing element within the at least one cutter pocket at the bottom end comprises casting the bearing element into the bottom end of the at least one cutter pocket.

17. The method of claim 15, wherein the outer bearing race is cast into the sidewall of the at least one cutter pocket.

18. The method of claim 15, wherein arranging the second end within the at least one cutter pocket adjacent the bearing element further comprises arranging a rear bearing surface disposed on the second end of the rolling cutter adjacent the bearing element such that the rear bearing surface engages the bearing element as the rolling cutter rotates about the central axis.

19. The method of claim 15, further comprising securing the sleeve to the sidewall of the at least one cutter pocket.

20. The method of claim 19, wherein bonding the bearing element within the at least one cutter pocket comprises arranging the bearing element in the at least one cutter pocket such that the bearing element protrudes from the bottom end and extends into an interior of the sleeve.

* * * * *